United States Patent [19]

Shirai

[11] Patent Number: 4,637,709

[45] Date of Patent: Jan. 20, 1987

[54] APPARATUS FOR GENERATING AN IMAGE FROM WITHIN A SHEET-LIKE MEMBER

[75] Inventor: Masaharu Shirai, Kanagawa, Japan

[73] Assignee: Fuji Xerox Co., Ltd., Tokyo, Japan

[21] Appl. No.: 684,710

[22] Filed: Dec. 21, 1984

[30] Foreign Application Priority Data

Dec. 23, 1983 [JP] Japan ..... 58-242244
Dec. 23, 1983 [JP] Japan ..... 58-242246
Dec. 23, 1983 [JP] Japan ..... 58-242247

[51] Int. Cl.[4] ..... G03G 15/00

[52] U.S. Cl. ..... 355/3 R; 355/12; 355/24; 355/78; 355/82; 430/363; 118/620; 250/324

[58] Field of Search ..... 250/324, 325, 326; 355/3 R, 3 SH, 12, 14 E, 24, 78, 82, 85, 89, 99, 104, 106, 113; 430/363, 396; 118/620

[56] References Cited

U.S. PATENT DOCUMENTS 3,370,212 2/1968 Frank ..... 250/324 X
3,405,052 10/1968 Schirmer ..... 230/324 X
3,546,545 12/1970 Sato et al. ..... 250/324 X
3,619,609 11/1971 Vehara ..... 250/324
3,649,117 3/1972 Weigl ..... 355/12
3,661,457 5/1972 Frech ..... 355/78
3,739,246 6/1973 Haas ..... 250/324 X
3,742,237 6/1973 Parker ..... 250/324
4,028,551 6/1977 Thompson ..... 250/324
4,053,770 10/1977 Tanaka et al. ..... 250/324
4,334,144 6/1982 Ferrarini ..... 230/324 X

*Primary Examiner*—A. C. Prescott
*Attorney, Agent, or Firm*—Finnegan, Henderson, Farabow, Garrett & Dunner

[57] ABSTRACT

The surface of a sheet-like member such as a sheet of paper may be illuminated by surrounding the member with confronted electrodes. Passing an AC voltage across the electrodes generates a corona discharge within the member. The light so produced facilitates the copying of images on the surface of the member by illuminating the surface from within.

13 Claims, 15 Drawing Figures

APPARATUS FOR GENERATING AN IMAGE FROM WITHIN A SHEET-LIKE MEMBER

BACKGROUND OF THE INVENTION

1. Field of the Invention

The present invention relates to means for obtaining an image from a sheet-like member by producing light within the member. The light so produced is attenuated by images on the surface thereof to provide means for copying the image.

2. Discussion of the Prior Art

In a conventional copying machine the image bearing surface of the original must be illuminated in order to facilitate the copying operation. This is conventionally done by a lamp and lens system but such devices are bulky, expensive and consume large amounts of electrical power.

A conventional copying machine, having a contact exposure system in which an original's surface is placed near or in contact with a photosensitive surface, uses contact transmission-type exposure. In such devices the original's surface is placed in contact with a photosensitive surface, while the other surface of the original is illuminated by illuminating means such as a lamp. Light passes through the original and is applied to the photosensitive surface. Alternatively, in such a contact exposure-type device, the original's surface may be kept in close contact with a photosensitive unit and the photosensitive unit is illuminated by illuminating means such as a lamp. Light reflected from the original's surface is applied to the photosensitive surface.

Such devices need, not only a lamp to illuminate an original's surface, but also a device for controlling the lamp.

Where it is required to copy, and therefore illuminate, both sides of an original, it is necessary for the operator to manually turn over the original or mechanical means for turning over an original must be provided. The first alternative requires a machine operator whose efficiency is reduced by the need to turn over the original and the second, a complex mechanical system. Both are undesirable. In addition, a copying machine using the contact transmission-type exposure device has the significant disadvantage that it cannot be used to copy an original having characters or patterns on both sides, because the characters or patterns on the two sides of the original would both be copied as if they were both on one side.

In order to form the electrostatic latent image of an original on a photosensitive surface in a conventional electrophotography device, the original's surface is illuminated with an external light source such as a lamp. The light reflected therefrom is applied through a lens or the like to the photosensitive surface which has been uniformly charged. That is, it is essential for the device to have optical means for illuminating the surface of an original, and therefore the device is unavoidably bulky.

A means for forming the electrostatic latent images of both sides of an original on two photosensitive surfaces simultaneously have never been proposed in the art.

SUMMARY OF THE INVENTION

An object of this invention is to provide a device which can form latent images of both sides of an original on two photosensitive surfaces without using illuminating means such as a lamp for illuminating the surfaces of the original.

Another object of the invention is to provide a device which can form latent images of both sides of an original without means for forming the images of the two sides of the original with optical devices such as a lens and mirror.

Still another object of the invention is to provide a device which can form the electrostatic latent images of both sides of an original on two photosensitive units at the same time.

In order to achieve these, and other objects, the invention comprises a device for illuminating at least one surface of a sheet like member from inside the member. The device includes two confronting electrodes, with at least one of the electrodes having an insulating layer thereon. There are also provided means for applying an AC voltage across the two electrodes which induces a corona discharge inside the member. The member is placed between the two electrodes such that the member contacts the electrodes and the insulating layer on at least one of the electrodes. Preferably the insulating layer is transparent. It is also preferred that the electrode not covered by the insulating layer comprise a photosensitive unit.

The method embodiment illuminates at least one surface of the porous member from the inside by placing a transparent insulating layer over at least one side of the member and applying an AC voltage across the member. The voltage and frequency are sufficient to cause a corona discharge inside the member.

Preferrably the porous member is paper and the voltage is in the range of from 1 to 30 kV and a frequency of from 50 Hz to 1 kHz.

The foregoing objects of the invention, other objects, as well as the characteristic features of the invention will become more apparent from the following detailed description and the accompanying drawings.

BRIEF DESCRIPTION OF THE DRAWINGS

In the accompanying drawings:

More specifically, FIG. 4 is a cross-sectional view showing one example of a device for exposing oneside of an original according to the invention.

FIG. 5 is a cross-sectional view showing one example of a device which has roll-shaped electrodes for exposing two sides of an original according to the invention.

FIG. 6 is an enlarged view of a portion of the device of FIG. 5 showing its principles of operation.

FIGS. 7 and 8 are cross-sectional views showing examples of a two-side exposing device using plate-shaped electrodes.

FIG. 9 is a cross-sectional view showing another example of the two-side exposing device having roll-shaped electrodes;

FIG. 10 is a schematic cross-sectional view showing a device for forming an electrostatic latent images of one side of an original.

FIG. 11 is a schematic cross-sectional view of a device for forming electrostatic latent images to both sides of an original.

FIGS. 12 and 13 are schematic cross-sectional diagrams for illustrating the principle of electrostatic latent image formation of the device of FIG. 11.

FIG. 14 is a schematic diagram showing the arrangement of an electronic copying machine wherein the surfaces of an original are illuminated from inside according to the invention.

FIG 15 is a schematic diagram showing the arrangement of an electrophotography device for simultaneously copying both sides of an original which has the electrostatic latent image formed according to the invention.

DESCRIPTION OF THE PREFERRED EMBODIMENTS

The present invention illuminates the surfaces of a member from the inside by generating a corona discharge within the member. As presently contemplated, the member must be porous and contain sufficient gas (e.g. air) to support the corona discharge. The preferred embodiments of the device illuminate the surface of a sheet of paper from the inside and paper is the preferred "member" as disclosed herein. Because the present invention has utility in a copier, the member may also be referred to herein as the "original."

A device for illuminating the surfaces of a porous member from the inside according to the invention includes two confronted electrodes. One of them may be covered with an insulating layer or an insulation layer which is separate from the electrodes may be placed therebetween. The device further includes means for applying AC voltage across the electrodes and means for placing the member to be illuminated between the electrodes in such a manner that it is in close contact with the electrodes.

If, in the device, the insulation layer is transparent, then the two surfaces of the member can be illuminated from the inside at the same time, through the transparent electrode. In the case where the surfaces are illuminated from the inside in order to project the images of the surfaces of the original onto photosensitive units, the confronted electrodes may comprise the photosensitive units. If, in this connection, at least one of the photosensitive units has a transparent insulation layer, then the images of the two surfaces of the original can be projected onto the two photosensitive units at the same time.

The device of the invention will be described with reference to the accompanying drawings.

Figure 1:
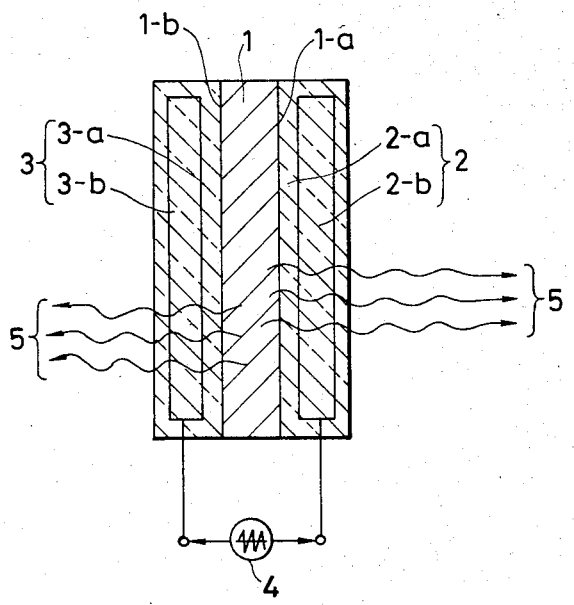
FIG. 1 is a schematic cross section depicting means for illuminating the surfaces of an original from inside according to this invention.

FIG. 1 shows the basic operation of an embodiment of the invention. In FIG. 1, a sheet of porous material 1 (e.g. a sheet of paper) and transparent electrodes 2 and 3, are disposed on both surfaces 1*a* and 1*b* of the sheet 1 in such a manner that the electrodes are in close contact with the two surfaces of the sheet under pressure.

The transparent electrodes (NESA glass for instance) 2 and 3 are formed by covering the transparent electrode layer 2*b* and 3*b* with transparent insulation layers (for instance glass), respectively. The sheet 1 is held between the transparent electrodes in such a manner that the inner surfaces of the transparent electrodes are pressed into close contact with the two surfaces of the sheet 1. Therefore, upon removal or the pressure, the sheet 1 is readily separated from the transparent elctrodes.

With the sheet held between the two transparent electrodes, a suitable AC voltage, having an appropriate frequency, is applied across the two transparent electrodes to cause a corona discharge to take place in the sheet so that both surfaces 1*a* and 1*b* of the sheet 1 are illuminated with light, ions or electrons generated inside the sheet, and the rays from inside the surfaces of the sheet are led outside as indicated by reference numerals 5 in FIG. 1.

Figure 2:
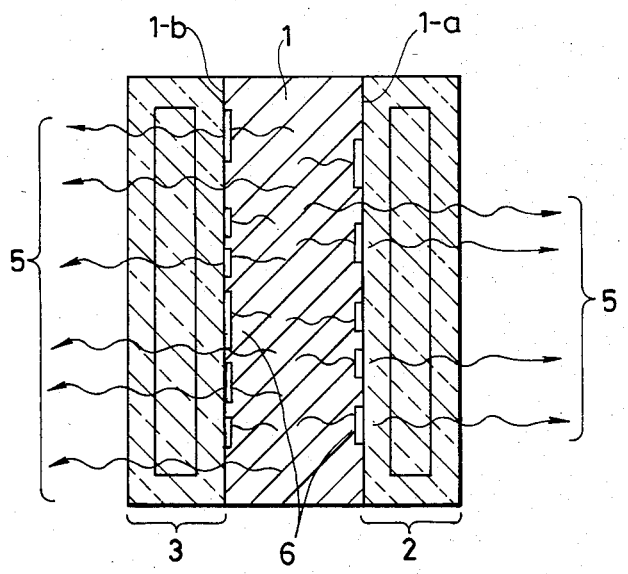
FIG. 2 is a schematic cross section depicting how light is generated inside an original, both sides of which have characters or patterns thereon.

In the case where there are data such as characters and patterns 6 on the surfaces 1*a* and 1*b* of the sheet 1 as shown in FIG. 2, light 5 from beneath the surfaces is attenuated in intensity according to the densities of the data 6. Therefore, the optical images of both surfaces of the sheet can be detected outside through the transparent electrodes 2 and 3.

The sheet which is caused to emit light by the present invention may be the ordinary paper which contains air inside, or a sheet-shaped material which is made of a porous insulator which contains air inside and also transmits light to some extent. It is not always necessary that both of the electrodes 2 and 3 be transparent. That is, if the electrode which is in close contact with the surface of sheet to be illuminated is transparent, then the optical image of the surface of the original can be obtained. In this case, the other electrode may not be transparent. It may simply be a metal plate-like electrode.

Figure 3:
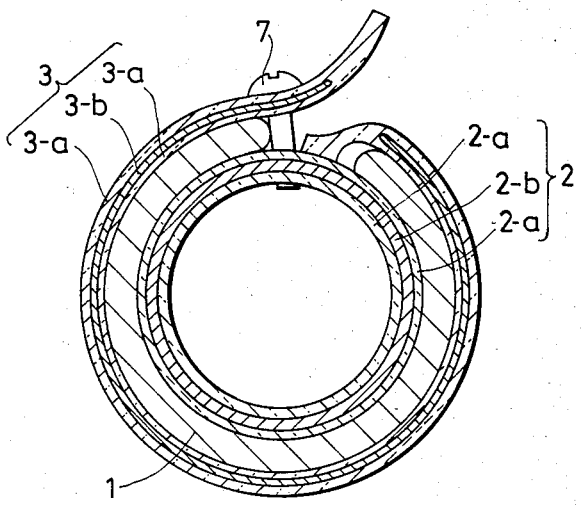
FIG. 3 is a schematic cross section showing another embodiment of the invention.

The device shown in FIG. 1 or 2 is relatively flat. However, the device has be modified as shown in FIG. 3. In FIG. 3, the device has coaxial cylindrically shaped electrodes. More specifically, a sheet 1 is held between a cylinder-shaped transparent electrode 20 and a sheet-shaped transparent electrode 30 with holding means 7.

The device of the invention can be used as a light source for illuminating the surface of an opaque object such as a photosensitive unit in a copying machine, that is, it can be used as a light source for image exposure. In this case, one side of the sheet to be subjected to image exposure is brought directly in close contact with the surface of the photosensitive unit which serves as an electrode. When it is required to expose data on both sides of a sheet to photosensitive units, the sheet should be illuminated with at least one of the photosensitive units brought directly into close contact with the sheet. This will prevent the occurrence of an electrical discharge between the two photosensitive units.

EXAMPLE 1

In the device as shown in FIG. 1, a printing sheet having pictures on both sides was set between the transparent electrodes (NESA glass) 2 and 3. Under this condition, a 50 Hz, 30 KV voltage was applied across the electrodes 2 and 3 for 0.5 to 1 sec. As a result, light was emitted, the intensity of which was high enough to blacken the ASA 100 monochromatic film on the outer surfaces of the transparent electrodes 2 and 3. However, with a voltage lower than 1 KV, the light emitted was so low in intensity that the film was not sufficiently blackened. With a 1 KHz, 2 KV voltage, ASA 32 monochromatic film could be blackened sufficiently even when the period of application of the voltage was shorter than 0.5 second. With a 1 KHz, 5 KV voltage, the film could be blackened sufficiently even when the voltage application period was shorter than 0.1 second.

However, when the applied voltage was higher than 10 KV (at 1 KHz), discharge occurred between the electrodes, and light was not satisfactorily emitted. When a 50 Hz, 6 KV voltage was applied across the electrodes, light from the surfaces of the sheet 1 could be observed with the naked eye through the transparent electrodes in a dark room, and the characters printed on the surfaces could be read.

One example of the application of the present invention to a copying machine is a device adapted to expose one side of an original of paper or the like. The exposure device comprises: two confronted electrodes at least one of which has an insulation layer on its surface; means for placing a sheet and a sheet-shaped photosensitive unit between the electrodes in such a manner that they are laid one on another; and means for applying AC voltage across the electrodes.

Another example is an exposure device for exposing both sides of an original sheet of paper or other porous material. Such a device comprises: two confronted electrodes at least one of which has an insulating layer on its surface; means for placing a sheet and two sheet-shaped photosensitive units between the confronted electrodes in such a manner that the sheet is placed between the photosensitive units; and means for applying AC voltage across the electrodes.

Figure 4:
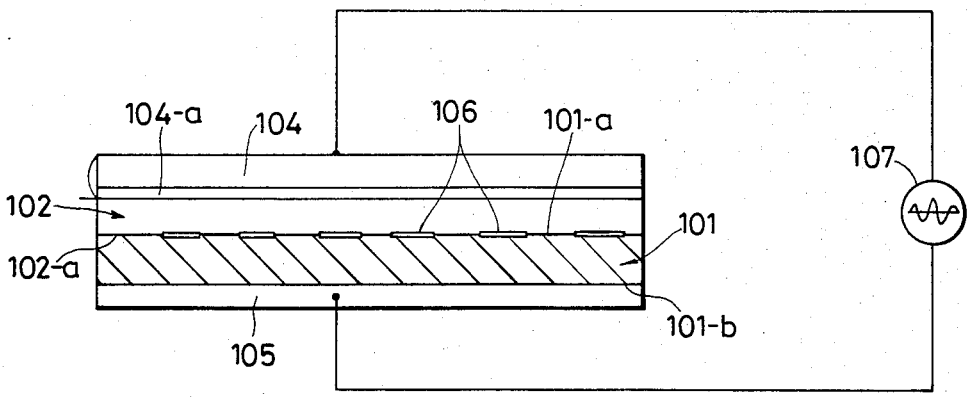
FIGS. 4 through 15 are schematic diagrams showing the arrangements of embodiments which employ the present invention.

FIG. 4 is a cross-sectional view of a device for exposing one side of an original, In FIG. 4, a porous sheet-shaped original 101, which is preferably paper, has data 106 on one side 101*a*. A sheet-shaped photosensitive unit 102 is placed on the surface 101*a* of the original. An electrode plate 104 having an insulation layer 104*a* is placed on the photosensitive unit 102 in such a manner that the insulation layer 104*a* is in close contact with the photosensitive unit 102. A bare electrode plate 105 is placed on the other surface of the original which has no data, in such a manner that the two electrode plates confront each other. The confronted electrode plates 104 and 105 are connected to an AC source 107. When, under this condition, an appropriate AC voltage having a suitable frequency is applied across the electrode plates, then the emission of light is caused in the original 101 by corona discharge. The light passed through the original surface 101*a* to the sheet-shaped photosensitive unit 102. Because of the data 106 on the original surface 101, the light is attenuated in intensity by the data 106 before reaching the surface 102*a* of the photosensitive unit. Accordingly, the optical image of the surface of the original is projected onto the photosensitive unit's surface 102*a*.

In the device of FIG. 4, the electrode plate 104 having the insulating layer is placed on the side 101*a* of the original having the data, however, the positions of the electrode plates 104 and 105 may be exchanged. Furthermore, instead of the electrode plate 105, an electrode plate having an insulation layer may be used.

Figure 5:
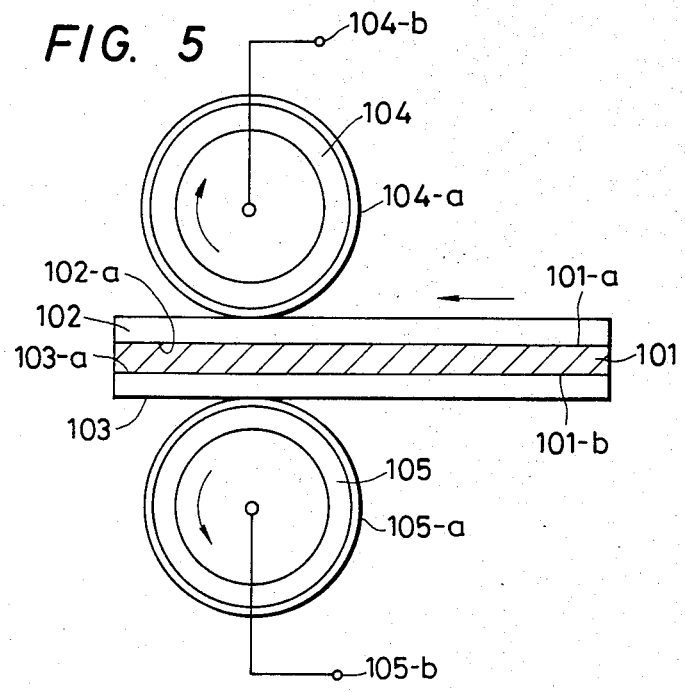
Figure 6:
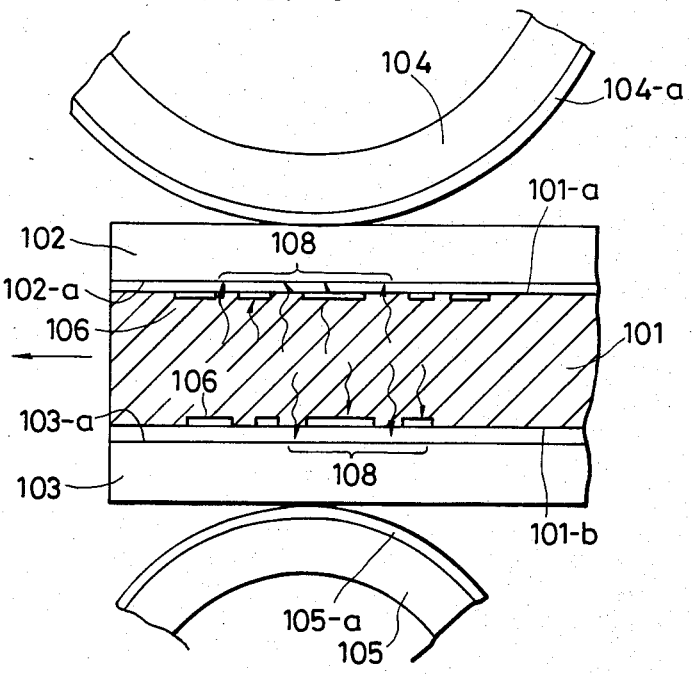

FIG. 5 is a cross-sectional view showing a device for exposing both surfaces of an original. In FIG. 5, reference numeral 101 designates a porous sheet-shaped original. The photosensitive surfaces 102*a* and 103*a* of two sheet-shaped photosensitive units 102 and 103 are in contact with both surfaces 101*a* and 101*b* of the original 101, respectively. The original 101 and the two sheet-shaped photosensitive units 102 and 103 are held between two confronted electrode rolls 104 and 105 which have insulation layers 104*a* and 105*a* on their respective surfaces. At least one of the electrode rolls 104 and 105 is rotated to move the original 101 and the photosensitive units 102 and 103 together at a constant speed. The terminals 104*b* and 105*b* of the electrodes 104 and 105 are connected to AC voltage applying means (not shown), so that an appropriate AC voltage having a suitable frequency is applied to the photosensitive units 102 and 103 and the original 101. As a result, corona discharge occurs inside the original 101 and emits light. The light thus emitted reaches the photosensitive surfaces 102*a* and 103*a* of the photosensitive units 102 and 103 through the original's surfaces 101*a* and 101*b* at the same time. If there are data such as characters and patterns 106 on the surfaces 101*a* and 101*b* of the original 101 as shown in FIG. 6, the light 108 generated inside the original 101 is attenuated in intensity according to the data, and reaches the photosensitive surfaces 102*a* and 103*a*. Thus, the optical images of the two sides of the original are projected onto the photosensitive surfaces 102*a* and 103*a* at the same time.

EXAMPLE 2

In a device similar to that depicted in FIG. 5, two electrode rolls 104 and 105 were formed by placing a "Mylar" layer on the outer surface of an aluminum roller. The rollers 104 and 105 were used to transport an original 101 (having characters printed on both sides) and two sheets of ASA 100 photographic film 102 and 103 in such a manner that the photosensitive surfaces 102*a* and 103*a* of the photographic film were in close contact with the two surfaces of the original. While the sheets of photographic films 102 and 103 and the original 101 were moved under pressure from the electrode rolls 104 and 105 at a speed of about 67 mm/sec, a 50 Hz, 6 KV voltage was applied across the electrode terminals. The sheets of photographic film were developed in the conventional manner, as a result of which the images of the two surfaces 101*a* and 101*b* of the original 101 were copied on the photographic films 102 and 103, respectively. In the case where the frequency of the AC voltage and the processing speed were maintained unchanged and only the voltage was changed, with a voltage of 1 KV or lower, the films were not blackened; i.e., the images of the surfaces of the original could not be copied, and with a voltage of 8 KV or higher, the characters and patterns could not be copied clearly; i.e., the developed images were foggy. As a result, it was found that a voltage of 4 to 7 KV was most suitable.

The processing speed can be increased by increasing the frequency of the AC voltage. For instance, at a processing speed of about 267 mm/sec, the frequency should be set to about 200 Hz; and for a processing speed of about 530 mm/sec, the frequency should be set to about 500 Hz. With a KHz, 4 KV voltage, the copying operation could be achieved satisfactorily even at a speed of 1300 mm/sec. In the case where the frequency is increased, the copying operation can be achieved with high density when compared with the case where the frequency is decreased. However, it was not suitable to increase the frequency to higher than 5 kHz and the voltage to higher than 10 KV, because electrical discharge or leakage occurred. A variety of photographic films were used as the photographic film sheets 102 and 103. As a result, it was found that the copy density and contrast increased with the film sensitivity.

Two sheets of photographic paper such as "FUJI RC paper" which contains little air inside were used as the photosensitive units 102 and 103, and the same voltage as that in the case of the above-described photographic paper, the negative images of the two surfaces 101*a* and 101*b* were obtained at the same time.

Figure 7:
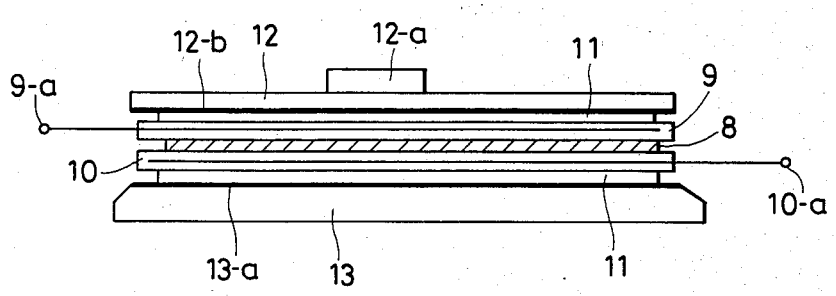

In a copying machine of the type shown in FIG. 7, an original 8 having data on both sides is held between transparent, insulated sheet-shaped electrode members 9 and 10 each of which has a transparent conductive layer on its inside surface. AC voltage is applied between terminals 9*a* and 10*a* to generate light inside the original, so that the images of the data on the two surfaces of the original are projected onto sheet-shaped photosensitive units 11 and 11' placed on the outer surfaces of the sheet-shaped electrode members 9 and 10. In this embodiment, the original 8, the electrode members 9 and 10 and the photosensitive units 11 and 11' are held under pressure between the elastic surface 13*a* of a pressurizing stand 13 and the elastic surface 12*a* of a pressurizing plate 12. Accordingly, the photosensitive units are brought into close contact with both sides of the original, and therefore the optical images will not be deformed when projected onto the photosensitive units. The optical images of the two sides of the original can be projected onto the two sheet-shaped photosensitive units as described above. Examples of the sheet-shaped photosensitive units are a diazo photosensitive sheet, photographic paper and photographic film. The optical images thus projected are developed and fixed according to methods which are appropriate to the different types of photosensitive units.

In the copying machine of FIG. 7, the optical images of both sides of the original are projected onto two sheet-shaped photosensitive units. However, the copying machine can be used for projecting only the optical image of one side of an original onto one sheet-shaped photosensitive unit.

Figure 8:
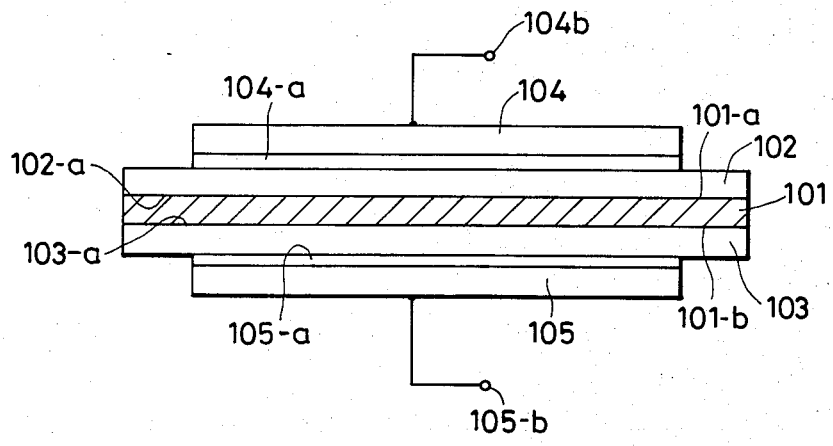
Figure 9:
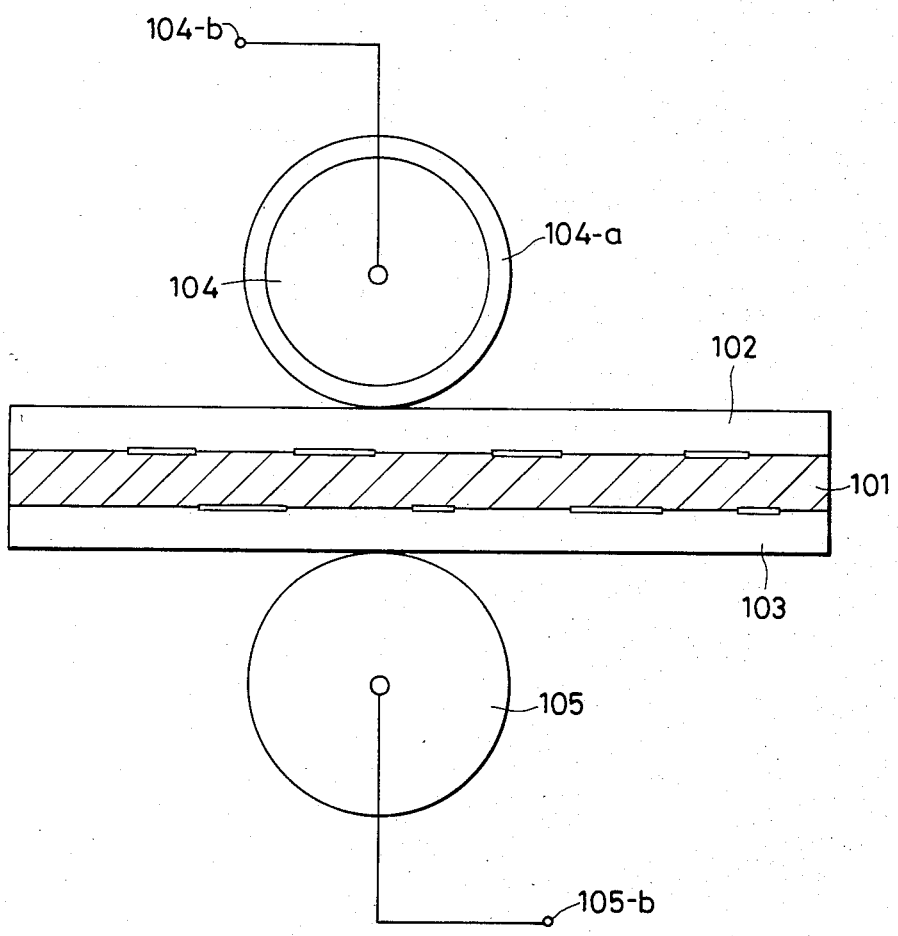

FIG. 8 is a cross-sectional view showing a device which uses flat electrode plates to obtain images from both sides of an original. In the above-described device of FIG. 5, the electrode rolls having the insulation layers 104*a* and 105*a* confronted each other. In the device of FIG. 8 also, the confronted electrode plates have insulation layers 104*a* and 105*a*. However, in each of the devices in FIGS. 5 and 8, one of the confronted electrodes need not have an insulation layer. One example of such a device is as shown in FIG 9. FIG. 9 shows a device for exposing an original 101 having data on both sides. Two sheet-shaped photosensitive units 102 and 103 are placed respectively on both surfaces of the original 101 and are held, under pressure, between an electrode roll 104 having an insulation layer on its surface and a bare electrode roll 105.

If, in the invention, a photosensitive unit such as ordinary photographic film or plastic-based photographic paper which scarcely contains air inside and is sufficiently high in breakdown voltage is used, the electrodes 104 and 105 need not have insulation layers. Furthermore, if transparent insulation layers such as plastic film are provided between one side of the original and the photosensitive unit's surface 102*a* and between the other side of the original and the photosensitive unit's surface 103*a*, then the electrodes need not have insulation layers on their surfaces.

When in accordance with the invention, a corona discharge is created inside the original, in addition to light, ions or electrons are produced therein. Therefore, if photo-resist materials or electron-resist materials which react with ions or electrons are placed on both sides of the original, then the images of the two sides of the original can be formed on such materials.

An example of the application of the present invention to an ordinary electro-photographic device is a device for forming an electrostatic latent image of one side of a porous original. Such a device would comprise confronted electrodes comprised of a photosensitive unit and an electrode plate; means for placing an insulation layer and the original between the confronted electrodes in such a manner that the insulation layer and the original are laid one on another; means for applying AC voltage across the confronted electrodes; means for charging the photosensitive unit; and means for transporting the original through the device.

Another example is a device for forming electrostatic latent images of both sides of a porous member or original. The device comprises: a pair of photosensitive units; means for holding an original and two transparent insulation layers placed on both sides of the original (or an original and one transparent insulation layer) between the photosensitive units; and means for charging the photosensitive units.

Figure 10:
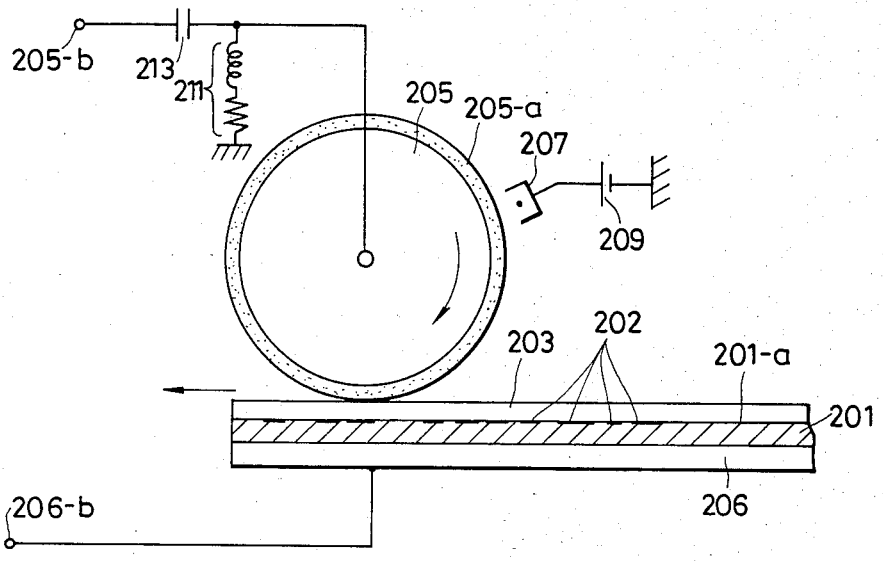
Figure 12:
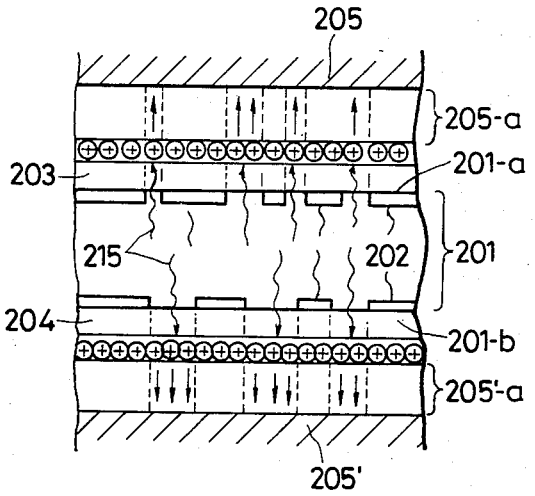

FIG. 10 is a cross-sectional view of one example of a device for forming a electrostatic latent image of one side of an original on a photosensitive unit. An electrode plate 206 is placed on the other side of an original 201 having a pattern 202 on one side, while a drum-shaped photosensitive unit 205 serving as an electrode having a transparent insulation sheet 203 on the one side, also is placed on one side of the original. That is, the original 201 and the insulation sheet 203 are held between the confronted electrodes 206 and 205. A charger 207 charges the photo-conductive layer 205*a* of the drum-shaped electrode 205 while 209 is the power source for the charger 207. An impedance circuit 211 holds the drum-shaped electrode at the ground potential or at a certain DC bias potential. An AC voltage is applie between a terminal 205*b* connected through a capacitor 213 to the drum-shaped electrode 205 and a terminal 206*b* connected to the electrode plate 206. The drum-shaped electrode 205 is rotated in the direction of the arrow so that the original 201 and the transparent insulation sheet 203 are moved in the left-handed direction at a constant speed while being held between the drum-shaped electrode 205 and the electrode plate 206.

In the device thus constructed, the surface 205*a* of the photo-conductive layer on the drum-shaped electrode 205 is first uniformly charged by the charger 207. Then the original 201 (covered with the transparent insulation sheet 203) is inserted between the electrode plate 206 and the drum-shaped electrode 205. While the original 201 and the insulation sheet 203 are being moved to the left, an AC voltage is applied between the electrode terminals 205*b* and 206*b*, so that a corona discharge occurs inside the original 201. The light which is generated by the corona discharge is attenuated in intensity by the patterns 202 on the original's surface 201*a* and the attenuated light reaches the photo-conductive layer 205*a* of the drum-shaped electrode 205 through the transparent insulation sheet 203. According to the exposure, the photo-conductive layer becomes electrically conductive and is discharged through the impedance circuit 211. As a result the electrostatic latent image of the original 201 is formed on the surface of the photo-conductive layer 205*a*.

In the embodiment of FIG. 10, a transparent insulation sheet is provided between the original and the drum-shaped electrode (photosensitive unit). However, such an insulation sheet may be provided between the original 201 and the electrode plate 206. It is not always necessary that the insulation sheet be transparent. Separate insulation sheets may be placed on both sides of the original but the insulation sheet placed on the side of the original which is to be copied should be transparent.

Figure 11:
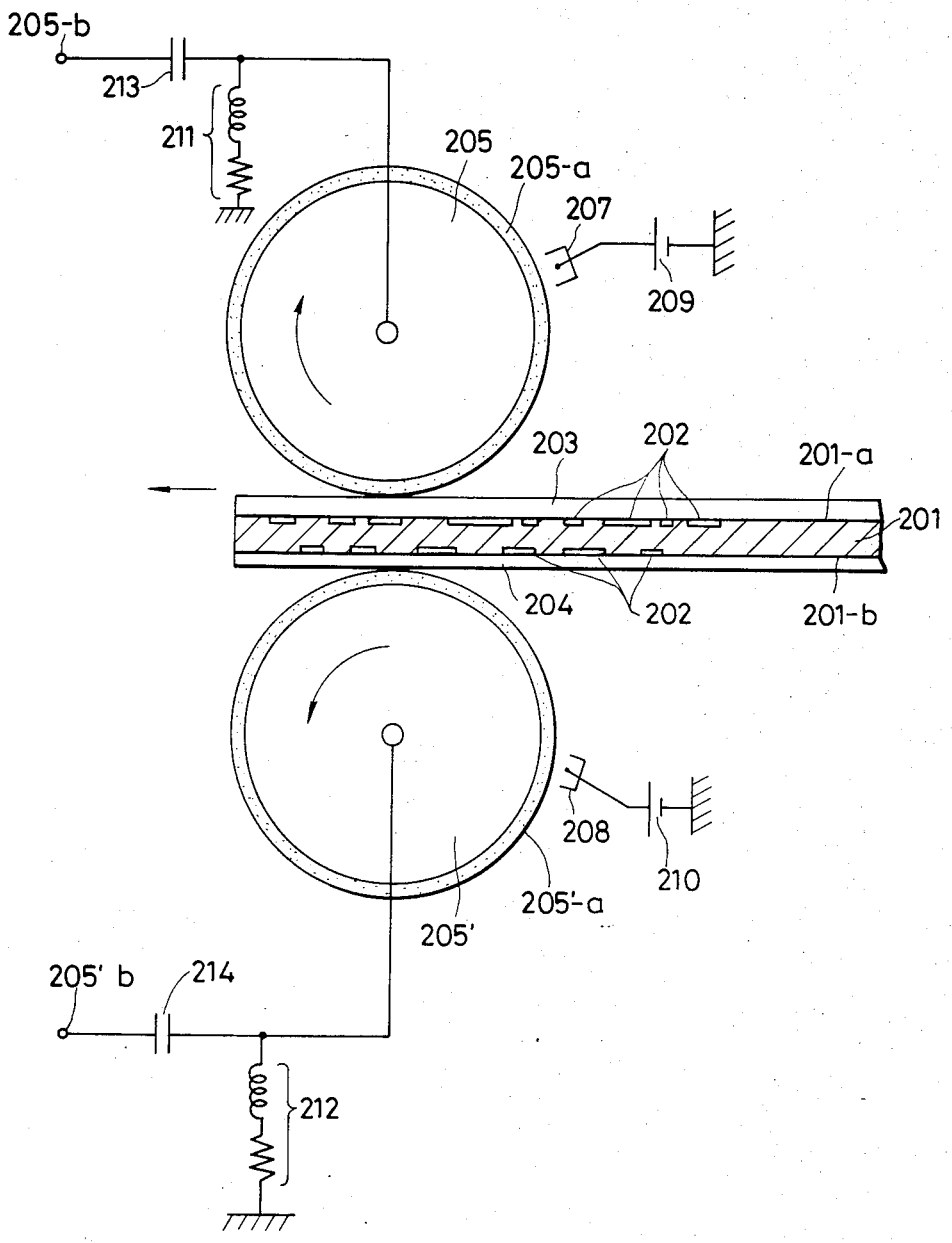

FIG. 11 is a sectional view of a device for forming electrostatic latent images of both sides of an original on two photosensitive units at the same time.

In this embodiment, instead of the electrode plate 206 in FIG. 10, there is provided a second drum-shaped photosensitive unit 205' also serving as an electrode. Two transparent insulation sheets 203 and 204 and the drum-shaped photosensitive units 205 and 205' are arranged symmetrically with respect to an original 201 which has information on both sides thereof. The original 201 and the insulation sheets 203 and 204 are placed on both sides of the original and are held between the drum-shaped photosensitive units under pressure. The drum-shaped photosensitive units 205 and 205' are rotated in opposite directions, to move the original 201 and the transparent insulation sheets 203 and 204 to the left in FIG. 11 at a constant speed. Chargers 207 and 208 are provided near the photosensitive units 205 and 205' respectively, to uniformly charge the photo-conductive layers 205*a* and 205'*a* positive or negative. Terminals 205*b* and 205'*b* are connected to the drum-shaped electrodes 205 and 205' through capacitors 213 and 214 and impedance circuits 211 and 212 which can hold the electrodes at the ground potential or certain DC bias potential, respectively. An AC voltage is applied between the terminals 205*b* and 205'*b*.

Figure 13:
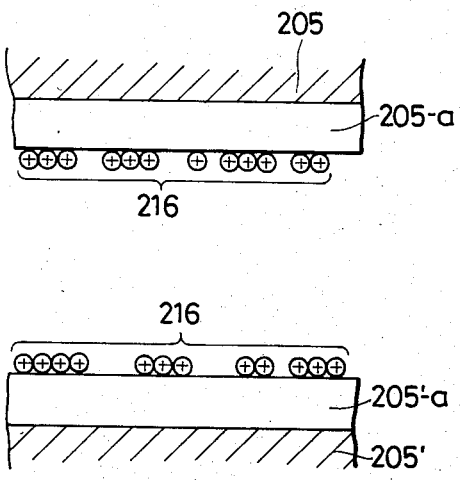

In this embodiment the surfaces of the photo-conductive layer 205*a* and 205'*a* are first uniformly charged positive or negative by the chargers 207 and 208, and the original 201 (covered with the two transparent insulation sheets 203 and 204) is inserted between the drum-shaped electrodes. While the original and the insulation sheets are being moved to the left by rotating the drum-shaped electrodes, an AC voltage is applied between the terminals 205*b* and 205'*b*, so that corona discharge occurs inside the original. The light generated by the corona discharge is attenuated in intensity by the pictures, characters and patterns on both sides 201*a* and 201*b* of the original, and the attenuated light reaches the surfaces of the photo-conductive layers 205*a* and 205'*a* through the transparent insulation sheets 203 and 204 respectively. The parts of the photo-conductive layers which have been exposed become electrically conductive, thus being discharged through the impedance circuits 211 and 212. As a result, as shown in FIG. 13, the electrostatic latent images 216 of the two surfaces of the original are formed on the surfaces of the photo-conductive layers 205*a* and 205'*a* at the same time.

In the embodiment of FIG. 11, the original 201 and the transparent insulation sheets 203 and 204 are moved by rotating the drum-shaped electrodes. However, if means for moving the original and/or the transparent insulation sheets is provided, then instead of the drum-shaped electrodes 205 and 205', plate-shaped electrodes can be used.

The embodiment depicted in FIG. 11 is used to form the electrostatic latent images of both sides of an original. However, it can also be used to form an electrostatic latent image of only one side of an original. In this case, it is unnecessary to provide the transparent insulation sheet for the other side of the original which is not to be copied.

EXAMPLE 5

In the embodiment depicted in FIG. 11, an original, having pictures on both sides was inserted between two transparent "Mylar" sheets. Drum-shaped photosensitive units each having a selenium photo-conductive layer (50 in thickness) on an aluminum roll were used. The drum-shaped photosensitive units were rotated at a peripheral speed of 800 to 1500 mm/sec. After the surfaces of the drum-shaped photosensitive units had been charged positive by the chargers, the original and the "Mylar" sheets were moved at the same speed of the peripheral speed of the drum-shaped photosensitive units while an AC voltage 500 to 1500 Hz, 6 to 8 KV was applied between the photosensitive units. Formation of the latent images on the drum-shaped photosensitive units was confirmed with a surface electrometer and by observation of figures which were formed by scattering charged toner on the units. When the voltage was set to an excessively low value, the corona discharge in the original became non-uniform, exposure also became non-uniform and the latent images were poor in quality. When the frequency was decreased, the quantity of light generated in the original was decreased, and accordingly it was necessary to slow down the speed of movement of the original. On the other hand, when both the voltage and the frequency were increased, the quantity of light generated inside the original was increased, and accordingly the speed of movement of the original could be decreased. Under such conditions, however, electrical discharge or leakage occurred outside the original.

Figure 14:
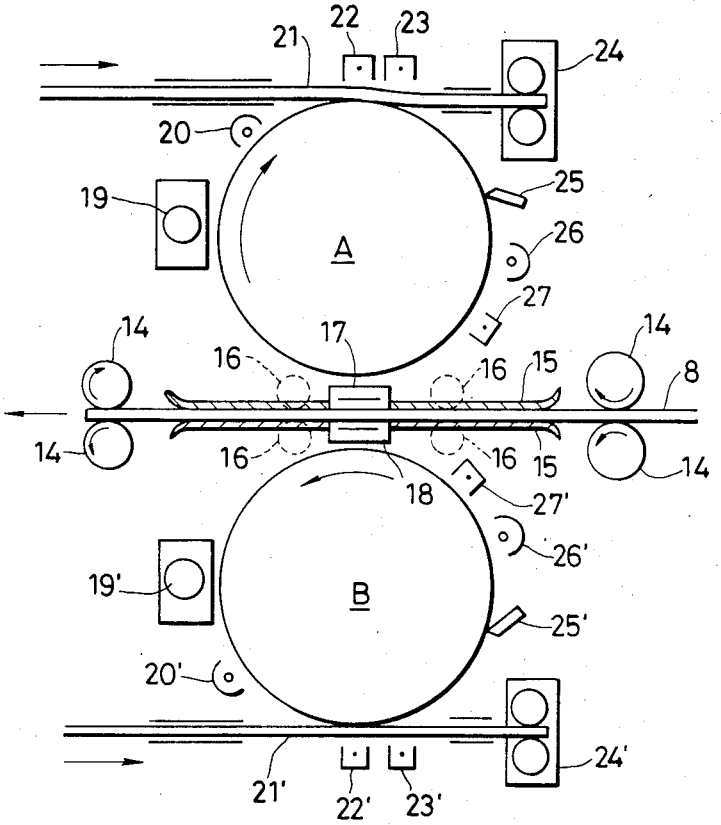

FIG. 14 depicts an embodiment of the invention using electrophotography.

In FIG. 14, electrode members 17 and 18 illuminate the surfaces of an original 8 according to the invention. The original 8, having information on both sides, is fed to exposure guide means 15 by conveying rolls 14 and inserted between electrode members 17 and 18 by exposure guide rolls 16. Each of the electrode members 17 and 18 is a plate-like transparent insulator of glass or plastic having a transparent conductive layers on the electrode members 17 and 18. The light thus generated is applied to photosensitive drums A and B adjacent the electrode members 17 and 18. The peripheral speed of the photosensitive drums A and B is in synchronization with the speed of movement of the original 8. The surfaces of the photosensitive drums A and B have been charged by chargers 27 and upon exposure, the electrostatic latent images of both sides of the original are formed on the surfaces of the photosensitive drums A and B at the same time. The latent images on the photosensitive drums A and B are developed by developing means 19 and 19'. The images thus developed are transferred onto transferring materials 21 and 21' supplied by sheet supplying means (not shown) and fixed thereon by fixing means 24. Thus, the images of both sides of the original have been formed on the two transferring sheets at the same time. The remaining elements of such a device common to electrophotography devices, such as elements 20, 20', 22, 22', 23, 23', 25–27 and 25'–27' function conventionally and no detailed description of their operation is needed.

As is apparent from the above description, in the copying machine using such an embodiment of the invention, does not need to use external illuminating means. Furthermore, it is unnecessary to turn over the original, and accordingly it is unnecessary to provide means for turning over an original. Therefore, the copying speed of the copying machine can be significantly increased.

Figure 15:
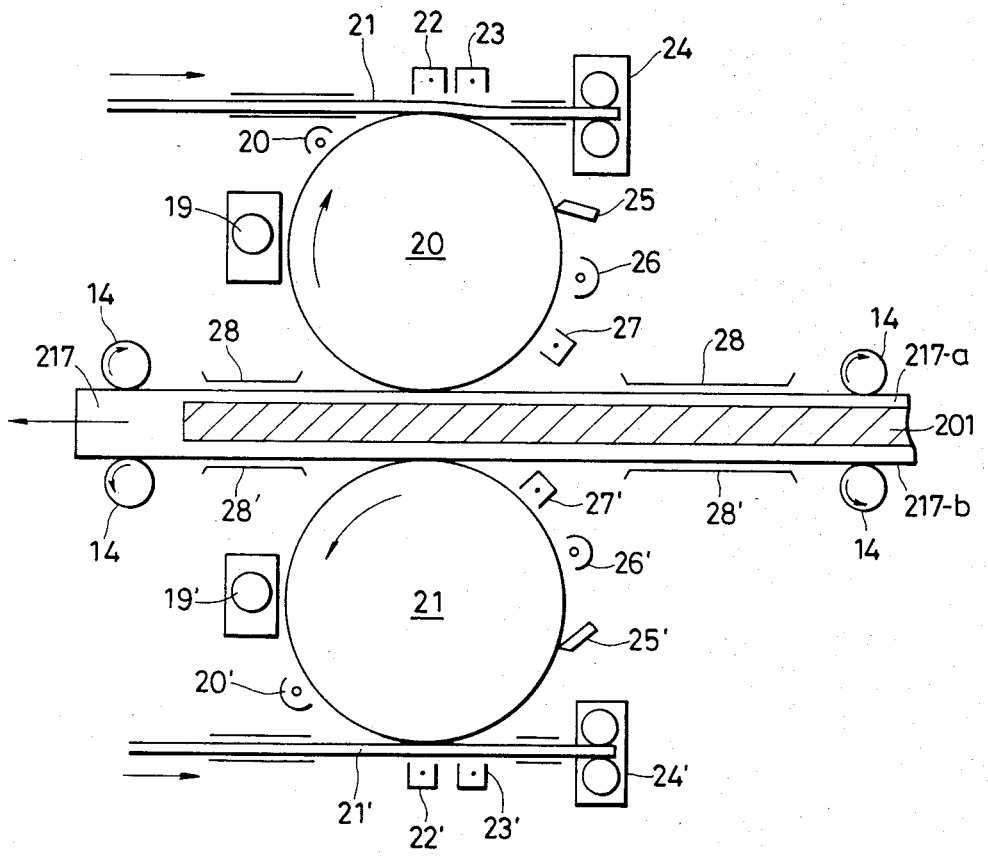

FIG. 15 depicts another embodiment of the invention using electrophotography for copying both sides of an original simultaneously. This embodiment of the invention also employs an electrostatic latent image forming exposure device.

As shown in FIG. 15, an original 201, having information on both sides is held between covers 217 made of flexible transparent insulation sheet (such as "Mylar"), and the original and the covers holding the original are inserted between photosensitive drums 220 and 221, through conveyance guide means 28, by conveying rolls 14. The peripheral speed of the drums 220 and 221 is equal to the speed of movement of the original. Light is generated inside the original by applying AC voltage between the photosensitive drums 220 and 221. The light thus generated passes through both surfaces of the original and is applied to the photosensitive drums 220 and 221, so that the optical images of both surfaces of the original are projected onto the photosensitive surfaces of the drums 220 and 221. Similarly, as in an ordinary electrophotography device, the surfaces of the photosensitive drums 220 and 221 are charged by chargers 27 and the other conventional elements of such devices 20, 20', 22, 22', 23, 23', 25, 25', 26 and 26' also function conventionally. Therefore, upon exposure, electrostatic latent images of the two surfaces of the original are formed on the surfaces of the two separate drums. These images are developed by developing units 19 and 19'. The images thus developed are transferred onto transferring materials 21 and 21' and are fixed by fixing means 24 and 24'.

As was the case with the embodiment of FIG. 14, this embodiment can copy both sides of an original at the same time. However, if this embodiment is used to copy only one side of an original, one of the two copying systems is not used and may be eliminated.

In the present invention, corona discharge is utilized to generate light inside an original, so that the image of the original is projected onto a photosensitive unit without using external illuminating means. Therefore, the images of both sides of an original can be projected onto photosensitive materials at the same time such units are placed adjacent the two surfaces of the original.

In the electrostatic latent image forming embodiment of the invention, it is unnecessary to use an external light source such as a lamp for illuminating an original and to provide optical means such as lenses and mirrors for forming the optical image of an original on the photo-conductive surface. Furthermore, with the devices of the present invention, the optical images of the two surfaces of an original can be projected on two photo-conductive surfaces at the same time.

The present invention has been disclosed both generally and by reference to specific embodiments. The invention is not to be limited to the embodiments disclosed. The scope of the invention is defined by the appended claims and their equivalents.

What is claimed is:

1. A device for obtaining an image from at least one surface of a sheet-like member bearing characters by producing light within said member, said device comprising:

two confronting electrodes, at least one of said electrodes having an insulating layer thereon;

means for placing said member between said two electrodes such that said member contacts said electrodes and said insulating layer on at least one of said electrodes;

means including said two electrodes for producing an image of at least one surface of the sheet-like member by inducing a corona discharge within the member, wherein said image is formed by light from said corona discharge attenuated by said characters; and means for utilizing the image.

2. The device of claim 1 wherein said insulating layer is transparent.

3. The device of claim 1 wherein the electrode not covered by said insulating layer is photosensitive.

4. The device of claim 1 wherein each of said electrodes has an insulating layer thereon disposed to contact said member when said member is between said electrodes.

5. A device for projecting an image from one side of a porous member bearing characters by producing light within said member, said device comprising:

two confronting electrodes, at least one of said electrodes having an insulating layer on the surface thereof;

a photosensitive unit having a sheet-like shape;

means for placing said member and said photosensitive unit between said electrodes such that said member and said photosensitive unit are laid one on another; and means including said two electrodes for projecting an image from at least one side of the members onto said photosensitive unit by indusing a corona discharge within the member, wherein said image is formed by light from said corona discharge attenuated by said characters.

6. The device of claim 5 wherein said photosensitive unit comprises one of photographic paper and photographic film.

7. A device for projecting images simultaneously from opposite sides of a porous member bearing characters on each side, said device comprising:

two confronting electrodes at least one of said electrodes having an insulating layer on the surface thereof;

two confronting photosensitive units having a sheet-like shape;

means for placing said member and said two sheet-like photosensitive units between said electrodes such that said member is placed between said photosensitive units; and means including said two electrodes for projecting an image onto said photosensitive units from each side of said member by inducing a corona discharge within the member, wherein said images are formed by light from said corona discharge attenuated by said characters.

8. The device of claim 7 wherein said photosensitive units comprise one of photographic paper and photographic film.

9. A device for forming an electrostatic latent image from one side of a porous member bearing characters, said device comprising:

two confronting electrodes, one of said electrodes comprising a photosensitive unit, and the other comprising a plate-like electrode;

an insulating layer;

means for placing said insulation layer and said member between said electrodes such that said member and said insulation layer are laid one on another;

means for producing a latent image from one side of said member by inducing a corona discharge within the member, wherein said latent image is formed by light from said corona discharge attenuated by said characters;

means for charging said photosensitive unit to form said electrostatic latent image from said latent image; and means for transporting said member through said device.

10. The device of claim 9, wherein said insulation layer is transparent.

11. A device for forming electrostatic latent images simultaneously from opposite sides of a porous member bearing characters, said device comprising:

two transparent insulating layers, each confronting one of said opposite sides of said member;

two confronting photosensitive units;

means for placing said member and said insulating layers between said photosensitive units;

means for producing a latent image simultaneously on opposite sides of said member by inducing a corona discharge within said member, wherein said images are formed by light from said corona discharge attenuated by said characters; and means for charging said photosensitive units to form an electrostatic latent image from each said latent image.

12. The device of claim 11 wherein said device includes means for forming said latent images on said photosensitive units into an actual image.

13. The device of claim 12 wherein said photosensitive units comprise an opposed pair of drum-like members having a peripheral coating of photosensitive material.

* * * * *